US005333763A

United States Patent [19]

Lane et al.

[11] Patent Number: 5,333,763

[45] Date of Patent: Aug. 2, 1994

[54] PRESSURE ACTIVATION DEVICE

[75] Inventors: Wallace E. Lane, Moses Lake, Wash.; Michael L. Lane; Lowell T. Whitney, both of Arvada, Colo.; Michael D. Gerstenkorn, Golden, Colo.

[73] Assignee: Quoin Industrial Inc., Golden, Colo.

[21] Appl. No.: 968,834

[22] Filed: Oct. 30, 1992

[51] Int. Cl.[5] ..... B67D 5/42

[52] U.S. Cl. ..... 222/386.5; 222/389; 222/394

[58] Field of Search ..... 222/74, 130, 183, 386.5, 222/389, 394, 399, 541; 141/3, 25, 27

[56] References Cited

U.S. PATENT DOCUMENTS

| | | | |
|---|---|---|---|
| 3,023,750 | 3/1962 | Baron | 222/386.5 |
| 3,718,236 | 2/1973 | Reyner et al. | 222/386.5 |
| 3,949,911 | 4/1976 | Morgne | 222/386.5 |
| 4,870,805 | 10/1989 | Morgne | 222/386.5 |
| 4,896,794 | 1/1990 | Banks et al. | 222/386.5 |
| 4,923,095 | 5/1990 | Dorfman et al. | 222/386.5 |
| 5,009,340 | 4/1991 | Morgne | 222/389 |
| 5,035,351 | 7/1991 | Moran | 222/389 |

*Primary Examiner*—Andres Kashnikow
*Assistant Examiner*—Philippe Derakshani
*Attorney, Agent, or Firm*—Kyle W. Rost

[57] ABSTRACT

A trigger (18), containing one component (28) of a two component gas generating system and having a headspace (37), is closed by a pressure rupturable membrane (36) and located in an expandable pouch (10), in a reservoir of the other component (19) of the gas generating system, with the membrane (36) facing down. The pouch (10) is inserted into a dispensing container (44) for flowable product, and the container is sealed. Thereafter, the trigger (18) is activated by externally pressurizing the container by back flow of fluid through a dispensing valve (46), either by adding a gas or by adding flowable product, causing the membrane (36) to rupture and the trigger (18) to discharge its contents into the reservoir of the other gas generating chemical (19).

20 Claims, 1 Drawing Sheet

PRESSURE ACTIVATION DEVICE

TECHNICAL FIELD

The invention generally relates to dispensing, especially to dispensing with a discharge assistant such as a moveable trap chamber. More specifically, the invention relates to discharging from a container with a follower, especially a nonrigid follower, and more specifically a fluid pressure actuated follower. The invention discloses a trigger apparatus and method by which a pressure generator is selectively actuated in stages after the trigger and pressure generator are sealed within a chamber that also contains a dischargeable fluid.

BACKGROUND ART

This invention is broadly applicable to the art of dispensing, especially to dispensing flowable products or fluids of all types, specifically to dispensing liquids, and still more specifically to dispensing beverages. In its most specific application, the invention provides an apparatus and method for dispensing beer from a bulk container, such as a keg or a large bottle. In the art of bulk dispensing, a problem originates in the conflicting needs to maintain freshness and to dispense a variety of flowable products. Dispensing the product with a somewhat constant rate of flow requires that the pressure within the bulk container be supplemented as the product volume decreases due to use. In some containers, this need is met by providing a means for supplying additional gas, such as air, carbon dioxide or nitrogen into the container as required. While certain gases may be inert or at least do not degenerate the quality of the product, it is overly expensive and difficult to supply such a suitable gas with each bulk container of product, especially for home use. Further, placing substantially any gas over the product is likely to lead to changes that may be undesirable. Thus, in the beer dispensing art, the practice in the art has been to supply a pump, so that the bulk container can be repressurized as needed, employing ambient air as the propellant gas. In some instances, however, the practice has been to supply a cylinder of pressurized carbon dioxide. Both practices lead to certain disadvantages.

In the dispensing art, persistent problems relate to the interaction between the fluid and the propellant gas. For example, when the fluid is beer and the propellant gas is air or otherwise contains oxygen, the beer begins to oxidize and lose freshness, flavor and quality upon exposure to the propellant gas. Further, if common gases such as oxygen, nitrogen, or carbon dioxide are used, the carbonation level of the beverage is altered. Specifically, placing oxygen or nitrogen over the beverage alters the partial pressure of the carbon dioxide dissolved in the beverage, resulting in a loss of carbonation in the beverage. On the other hand, if carbon dioxide is employed as the propellant gas, the partial pressure of carbon dioxide increases, correspondingly increasing the carbonation of the beverage. In either situation the result is undesirable, since the nature of the beverage is altered.

The art contains at least one successful apparatus for pressurizing a bulk container for flowable product while separating the product from the propellant gas or pressure generator. This art is found in U.S. Pat. No. 4,923,095 to Dorfman et al. According to the teachings of the Dorfman patent, a sealed, expandable pouch or bladder contains a two-component gas generating system, such as citric acid and bicarbonate of soda. Initially, the two components are physically isolated so that they do not generate gas. The pouch can be inserted into a beverage container, such as a keg or large bottle, and the container then can be filled with beverage and sealed. At some point in time, either shortly before inserting the pouch or at a later time, the two components of the gas generating system must be placed in mutual contact so as to generate gas to expand the pouch and thereby pressurize the container to dispense the beverage. The pouch contains a plurality of sub-compartments so that it can expand in stages. As the beverage volume progressively decreases, pressure within the pouch progressively opens new sub-compartments. Each sub-compartment contains a component of the gas generating system, with the result that as each sub-compartment is opened, more gas can be generated.

The technology of the Dorfman patent effectively solves the problems of chemical interaction of the beverage and the propellant. However, it creates new and unsolved problems. Specifically, the problems are when and how to trigger or initiate intermixing of the two components of the gas generating system. If the components are mixed before the pouch is inserted in the keg, the pouch might expand too soon and be unusable. If the components are to be mixed after the pouch is inserted, inflation still might be too fast to allow filling the container with the beverage and sealing it. Causing the components to mix after the pouch is inserted, or after the container is filled with beverage, or after the container is sealed, is difficult and leads to unreliable performance.

The Dorfman patent proposes various ways that the gas system can be actuated within a suitable time frame. Notably, in a production line container filling situation, reliability must be very high since reworking already-filled containers is expensive in wasted time, wasted containers, wasted pouches, and wasted beverage. Dorfman proposes a slow-acting, time delayed, initial gas generating system in which two components of the system initially are isolated in adjacent sub-compartments. The system is activated by striking or otherwise applying pressure to the pouch to open and interconnect the two sub-compartments before it is inserted in the container. When the applied pressure has opened the sub-compartments and caused the two components of a gas generating system to mix, these components begin a slow generation of gas. No time-delayed system has proven to be fully satisfactory, since there are many possibilities for unreliable performance or malfunction. For example, the process of filling and sealing containers can involve unscheduled time delays of unpredictable length, so any pre-triggered activation of the gas system can lead to wasted materials.

Several proposed triggering techniques attempt to actuate the gas system after the container is filled and sealed. One method is to use a first open-ended sub-compartment that contains and isolates one component of the two component gas system in the pouch. This sub-compartment communicates at its open end with a second sub-compartment of the pouch, and this second sub-compartment contains the second component of the gas generating system. With this system, the open end of the various sub-compartments must be kept upright until the pouch has been inserted in the bulk container and the container has been filled. Thereafter, inverting the container, and hence the pouch, mixes the isolated first component with the second component and thereby actuates the gas system. However, this system is not satisfactory, since the pouches are likely to be inverted at any time by accident or while being handled and shipped. This triggering method also presents a problem because, in practice, the pouch must be folded before being inserted into the bulk container. Folding and inserting the pouch tends to squeeze and deform the sub-compartments, prematurely discharging the isolated chemicals from the sub-compartments, thereby prematurely initiating the gas generating system.

In the case of carbonated beverages, another proposal is that the beverage itself can actuate the gas generating system by use of its own carbonation. According to this method, a sealed container of actuating chemical, i.e., citric acid, is located inside the pouch. A barb is located inside the container near a flexible sealing membrane. This technique proposes that the pressure of the carbonated beverage eventually will flex the membrane against the barb, cutting the membrane and releasing the isolated chemical to initiate the gas generating reaction. This technique is not satisfactory, as it can be both costly and unreliable. It also offers the added danger that the barb will puncture the pouch itself, releasing the gas system chemicals into the beverage. Further, the carbonated beverage must become relatively warm to be able to generate enough pressure to activate such a trigger. In addition, in this method it is a very slow process to depend upon the carbonated beverage to generate enough pressure through warming. Thus, the method is unreliable and not suitable for a relatively high speed filling operation. Finally, this method is totally unsuitable for use with any non-carbonated fluid.

It would be desirable to develop a triggering technique that is highly reliable, repeatable and reproducible so that the components of a gas generating system can be actuated shortly after the pressure pouch is placed in the beverage container and the container has been filled and sealed.

Similarly, it would be desirable to have a pressure pouch that can be handled freely and pre-folded for ready insertion and deployment in the product container. This is possible, however, only if such handling will not actuate the gas generating system.

Also, it would be desirable to have a pressure pouch that can be pre-sterilized. With the triggering device shown in the Dorfman patent, other than the barbed trigger, pre-sterilization and pre-folding of the pouch are very difficult, since the trigger must be accessible immediately prior to insertion in the container or the pouch must be held upright until placed upright in the container. For example, if the pouch must be unfolded and struck to initiate gas generation, such handling and striking defeats the sterilization.

Most importantly, it would be desirable to have a pressure pouch that lends itself to high speed filling of the product container.

To achieve the foregoing and other objects and in accordance with the purpose of the present invention, as embodied and broadly described herein, the pressure activated trigger for a pressure pouch and method of operation of this invention may comprise the following.

DISCLOSURE OF INVENTION

Against the described background, it is therefore a general object of the invention to provide an improved trigger for a pressure generating system that is activated after being inserted into and sealed inside a product container and is reliable. The present invention provides extremely reliable activation by a provision to activate the trigger with an external pressure source.

Another object is to provide a trigger that permits the pressure pouch to be pre-folded. Such pre-folding is desirable for shipment, expedited handling and insertion into the product container, and reliable deployment within the product container.

A further object is to provide a trigger that permits pre-sterilization of the pressure pouch. Because this trigger does not require subsequent handling or unfolding of the pouch in order to actuate the trigger, pre-sterilization is practical.

An important object is to provide a trigger that is compatible with high speed handling techniques. This trigger can be used with a variety of machines, insertion techniques, and container filling techniques. Further, the cost must be low.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

The invention provides an improved trigger for use in combination with a dispensing container for flowable product, of the kind having a product dispense valve associated with the container and an expandable pouch contained within the container for pressurizing the container in a staged manner. The pouch contains an at least two-component gas generating system and is divided into a plurality of sub-compartments by pressure-separable seams. At least one of the sub-compartments contains a first component of the gas generating system and is in communication with a trigger enclosure that houses a second component of the gas generating system. The improved trigger includes an at least semi-rigid trigger housing that defines an opening in its wall. The housing forms an internal volume in communication with this opening and contains the second component of the gas generating system. The internal volume of the housing is larger than the volume of second component, thereby defining a headspace. A pressure rupturable membrane covers and seals the opening. This membrane is of the type that is rupturable by deformation into the housing internal volume under externally applied pressure.

According to another aspect, the invention provides an improved method of activating a trigger in a pressure generating device used in combination with a dispensing container for flowable product. The dispensing container is of the kind having a product dispense valve associated with the container and an expandable pouch contained within the container for pressurizing the container in a staged manner. The pouch contains an at least two-component gas generating system and is divided into a plurality of sub-compartments by pressure-separable divisions. At least a one of these sub-compartments contains a first component of the gas generating system and a trigger enclosure that houses a second component of the gas generating system. The improved method of activating the trigger includes the following steps. First, the method provides an at least semi-rigid trigger housing that defines both an opening in its wall and an internal volume. Next is placing in this internal volume a lesser volume of the second component of the gas generating system, thereby providing a headspace. In addition is selecting a membrane of material capable of rupturing under a preselected externally applied pressure when covering an opening of the size of the opening in the trigger housing and with the headspace provided in the internal volume, and sealing the opening in the trigger housing with the selected membrane. The trigger housing is located in the one sub-compartment of the expandable pouch, and the expandable pouch is located in the dispensing container, after which the container is sealed. Pressure is supplied into the dispensing container in quantity sufficient to deform the membrane into the housing internal volume and thereby rupture the membrane.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

This disclosure incorporates by reference U.S. Pat. No. 4,923,095 to Dorfman et al., issued May 8, 1990, for "Apparatus and Method for Generating Pressures for a Disposable Container." This patent describes the background and surrounding equipment of the present invention, including the structure and operation of a typical bulk product container, the structure and operation of the expandable pouch and its permanent and semipermanent seams, the typical composition and operation of the gas generating system, and the operation of the pressure pouch within the bulk container.

The first aspect of the invention is a triggering mechanism that actuates a two component gas generating system within a sealed pouch. The second aspect of the invention is a method of operation by which the triggering mechanism is actuated after the sealed pouch has been placed in a bulk product container, the product has been added, and the container sealed.

Figure 1:
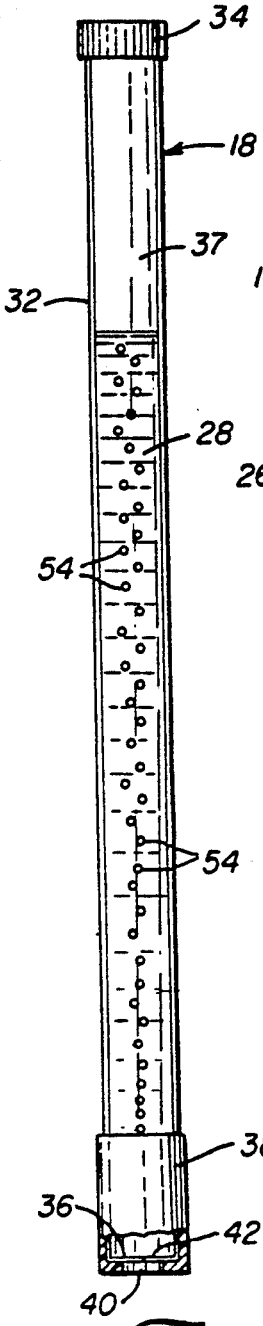
FIG. 1 is a side elevational view of the trigger mechanism, with an end closure partially broken away and showing an underlying membrane in cross-section.
Figure 2:
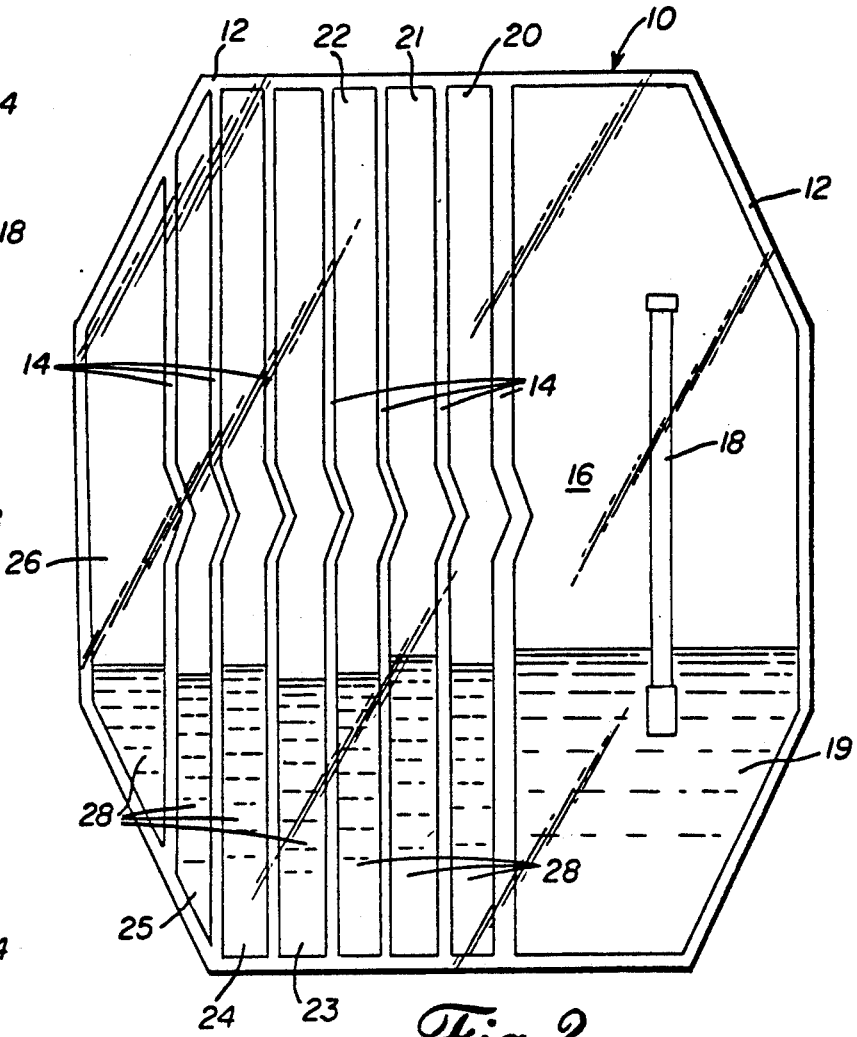
FIG. 2 is a top plan view of the expandable pouch containing the trigger.

FIG. 2 shows the general arrangement of the expandable pouch 10. It is formed of two sheets of plastic or other gas impermeable material, permanently sealed together at perimeter edges 12. Such relatively permanent seal can be achieved by known techniques of heat sealing at predetermined temperatures for predetermined times. In addition, the sheet material is joined together by pressure-separable means at one or more divisions or seams 14 that define a plurality of sub-compartments within the pouch. These seams 14 are referred to as peelable sees, since they can be forced to separate and thereby interconnect juxtaposed compartments by peeling open under pressure within the pouch. This type of seam can be formed by known techniques, including heat sealing at a slightly lower temperature than that used on edges 12. One of the sub-compartments 16 contains the trigger 18, shown in more detail in FIG. 1. While sub-compartment 16 is shown as being located at one edge of the pouch, this sub-compartment can be located at any relative position in the pouch. Sub-compartment 16 also serves as a reservoir of a first one of the elements 19 of the two component gas generating system, such as a solution of sodium bicarbonate. The additional sub-compartments 20–26 each serve as a reservoir of the second element 28 of the two component gas generating system, typically a food grade acid such as citric or acetic acid. In non-food products, the second component 28 can be any suitable acid. The trigger 18 is a sealed enclosure or chamber that also contains the second element of the gas generating system. The number of sub-compartments is variable according to the requirements of each application. Likewise, the choice of which component of the gas generating system is considered to be the first or second component is a matter of choice, and correspondingly, the identities of the component in the trigger 18 and in the various sub-compartments could be reversed.

The operation of the expandable pressure pouch begins when the trigger supplies its contents into the main sub-compartment 16, where the two components of the gas generating system mix initially and interact. As the sub-compartment 16 fills with gas, the gas forces apart and opens the peelable seam that separates sub-compartment 16 from a juxtaposed sub-compartment, for example sub-compartment 20, thereby supplying an additional quantity of the second component 28 of the gas generating system to the contents of sub-compartment 16. The added quantity of the second component causes further generation of gas, which will tend to open further peelable seams, generate more gas, and continue the cycle. The expansion of the pouch is limited, however, by the available volume within the bulk container. Consequently, the sequence of opening sub-compartments is limited by how much of the beverage or fluid product has been dispensed at any one time. The pouch and bulk container are related to each other in size, so that the pouch substantially fills the bulk container when fully expanded, thereby dispensing the full quantity of beverage or other flowable product from the container.

With reference to FIG. 1, the trigger 18 is formed of an enclosure or housing means defining an internal volume for containing a component of the gas generating system. This trigger may be a separate container or enclosure, a chamber or sub-compartment of the pouch 10, an attachment to pouch 10, or the like. The preferred embodiment is a trigger container that is semi-rigid, so as to resist externally applied pressure, and that is closed by a trigger membrane at one opening. For example, the trigger container may be a semi-rigid tubular housing 32 having one end closed by an end cap 34 and the second end open, but covered by trigger membrane 36. Alternatively, the trigger container may have an integral sealed end in place of cap 34, somewhat like the construction of a test tube. The trigger container is partially filled with a component 28 of the gas generating system, such as citric acid, leaving a small amount of headspace 37 within the trigger container. As shown in FIG. 2, the trigger container is inserted into the pressure pouch 10 in the main sub-compartment 16, which contains another component 19 of the gas system, for example, sodium bicarbonate.

The trigger membrane 36 is rupturable under applied pressure. It may be formed, for example, of low density, thin plastic that will rupture in preference to the housing 32 or end cap 34. This membrane may be applied to the housing 32 by use of a plastic retention cap 38 that defines an aperture 40 over the opening 42 in the housing 32. The retention cap retains the membrane over opening 42 and under aperture 40.

Figure 3:
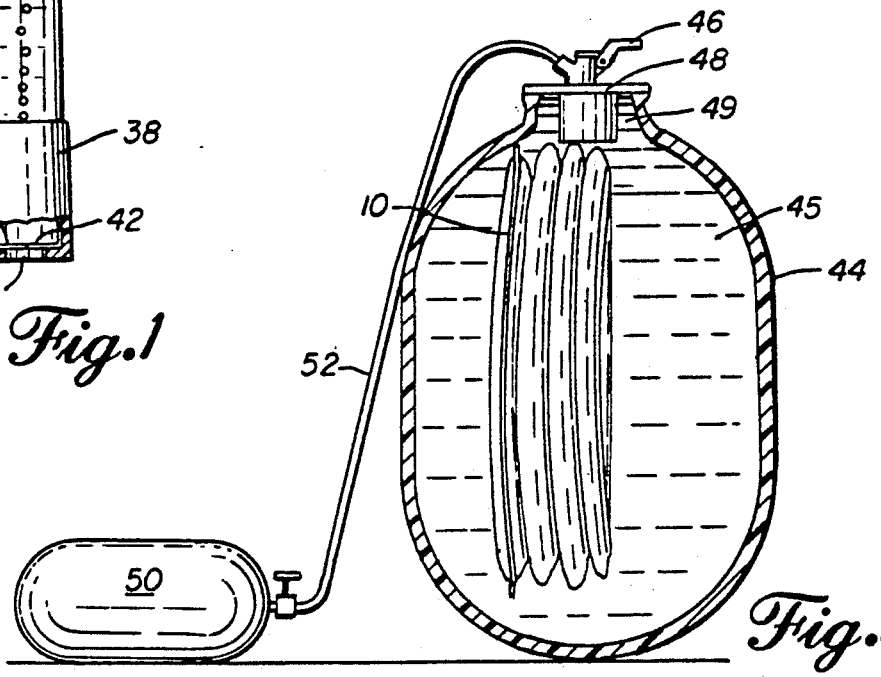
FIG. 3 is a side elevational view, in partial cross-section, of a typical bulk beverage container containing the pouch and beverage, showing the method of actuating the trigger.

With reference to FIG. 3, the product container 44 is of any design suited to hold flowable product 45. It is provided with a product dispense valve 46 that can be opened and closed selectively. The preferred product dispense valve is of a known type that permits pressurized fluid to be back-flowed into the container, while the valve prevents loss of fluid pressure while it remains in closed position. The product container 44 may be provided with an additional access opening or other means for receiving flowable product 45. For example, the container may have an opening 49 several inches in diameter in which the valve 46 is removably mounted. Alternatively, a removable and resealable cap or plug 48 may seal the opening, and the valve can be carried on the plug. The access opening 49 in the container should be sufficiently large that the pressure pouch can be inserted and the container filled with product 45 through this opening.

The operation of the trigger in connection with a dispensing container requires, first, that the trigger is located in the pressure pouch, at least to the extent that the trigger membrane is in communication with sub-compartment 16. Next, the pressure pouch, with trigger installed, is inserted into the product container through its access opening 49, with the trigger membrane 36 positioned toward the bottom of the trigger housing 32. If the dispensing container is to be filled with flowable product 45, this step may be accomplished before or after the insertion of the pouch. Thereafter, the container is closed and sealed, such as by installing the dispense valve 46 or plug in the access opening. Next, the product container is pressurized, such as by back-flowing a compatible gas through the product dispense valve.

While pressurizing, the product container should be positioned to maintain the trigger membrane 36 in a substantially downward disposition, near the bottom of the trigger housing 32, such that the membrane is in the reservoir of the first component 19 of the gas generating system. In FIG. 3, the pressurizing step is shown schematically by the gas cylinder 50 supplying pressurized gas through conduit 52 inserted in product dispense valve 46. The source of gas can be any known or later developed means, including a pressure cylinder or a hand or mechanical pump. The added gas pressure acts upon the trigger membrane, since the pressure within the semi-rigid trigger container otherwise remains substantially constant. At a sufficient pressure the membrane will rupture, allowing the two components 19, 28 of the gas generating system to mix and thus generate gas to inflate the pressure pouch 10 as described above. The downward disposition of the membrane contributes to the reliable operation of the trigger after the membrane ruptures. The location of the membrane within a reservoir of the first component 19 results in the initial reaction of the two components generating gas bubbles 54, FIG. 1, which rise inside the trigger housing 32. This gas pressure expels the second component 28 from the trigger housing 32 through the ruptured membrane and into the reservoir of first component 19 in sub-compartment 16. The gas generating reaction thereafter is rapid.

An alternative method of activating the trigger is by adding liquid to the product container 44, after the pouch 10 has been inserted, until sufficient pressure develops to rupture the membrane 36. According to this method, the product container 44 is purged of air by a stream of gas, such as by a stream of carbon dioxide. Thereafter, the container 44 is sealed, and flowable product 45 is back-flowed through the dispense valve 46 to fill the container 44. The addition of product will place the residual gas in the product container 44 under increasing pressure, which will reach the required pressure to rupture the trigger membrane 36. The residual gas directly in contact with the flowable product 45 likely will be fully absorbed into the product, with the result that the product container will be entirely filled by only flowable product and the pressure pouch 10. Alternatively, the residual gas could be expelled from the container through the valve.

The following details illustrate the scope of the invention as applied to a variety of product container sizes:

1. A reliable trigger for bulk beverage or fluid product containers was constructed of plastic tubing, ½ inch outside diameter, 025 inch wall thickness; a plastic 10 end cap on the top end; a plastic cap on the bottom end, with a hole in it in the range 5/16 to 3/8 inch; and a rupturable membrane of 0.4 to 2.0 rail thick low density polyethylene. The preferred range of membrane thickness is about 0.5 to 1.5 mil.

2. The trigger container is partially filled with a liquid component of the gas generating system, such as citric acid. The trigger requires a minimum amount of air headspace to work properly. In a ½ inch diameter trigger, a minimum of about 2 ml. of air headspace is required. A headspace of at least about 3 ml is preferred.

3. The applied pressure to rupture the trigger membrane is a function of the diameter of the trigger tube and the thickness of the trigger membrane. With a ½ inch tube and a 1.2 mil plastic membrane, rupture takes place at 15–20 psig; a 0.65 rail membrane ruptures at 10–15 psig; a 1.0 mil membrane with 4 ml of headspace ruptures at about 18 psig.

4. A trigger for a 10 liter container is ½ inch outside diameter × 6.25 inch long and contains 12 ml. of dilute acid. A trigger for a 3 liter container is ½ inch outside diameter × 4⅛ inch long and contains 6 ml. of dilute acid. A trigger for a 750 ml. container is ½ inch outside diameter × 3 inch long and contains 2.5 ml. of dilute acid.

The product and method are widely applicable to a broad variety of dispensing situations. A primary advantage of the invention is that the trigger does not require addition of a propellant gas to the product container. Thus, no foreign gas contacts or interacts with the flowable product. Thus, the product does not become carbonated or otherwise gas-filled even though it is stored and dispensed under pressure. As a result, certain products can be dispensed under pressure that previously would not be packaged in this way. For example, condiments like mustard, mayonnaise, and ketchup would be regarded as adulterated if they contained carbonation. Soft cheese spreads, soaps, lotions, gels, and creams likewise can be dispensed under pressure. Chemicals, including insecticides, are a particularly likely category of applicable products, since even highly reactive, short-lived materials can be stored under pressure without exposure to a potentially co-reactive or contaminating gas.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

We claim:

1. An improved activation device, suited for use in combination with a dispensing container for flowable product, containing a trigger enclosure in communication with at least first and second components of an at least two-component gas generating system for pressurizing the container, the trigger enclosure housing the second component of the gas generating system; wherein the improvement comprises:

said trigger enclosure is an at least semi-rigid housing defining therein a housing internal volume and an external opening communicating with said housing internal volume, wherein the housing internal volume contains the second component of the gas generating system and is larger in volume than the contained volume of the second component, thereby defining an internal headspace; and a membrane covering and sealing said opening and being rupturable by deformation into said housing internal volume under pressure externally applied to the membrane said pressure supplied into the dispensing container.

2. The activation device of claim 1, further comprising a product dispense valve of the type capable of receiving back flow of pressurized fluid into the dispensing container, and an external means for supplying fluid under pressure, connected to said product dispense valve and supplying fluid under pressure into said dispensing container with sufficient pressure to deform said membrane into said housing internal volume and thereby rupture the membrane.

3. The improved activation device of claim 2, wherein said pressurized fluid comprises a gas.

4. The improved activation device of claim 2, wherein said pressurized fluid comprises a liquid.

5. The improved activation device of claim 1, wherein said trigger enclosure comprises a material having the semi-rigid characteristics of approximately 0.025 inch thick plastic configured as a tube of approximately 0.5 inch outside diameter.

6. The improved activation device of claim 5, wherein said membrane comprise a material having the rupturable characteristics of low density polyethylene having a thickness of from about 0.4–2.0 mil.

7. The improved activation device of claim 6, wherein said membrane comprises a material having the rupturable characteristics of low density polyethylene having a thickness of from about 0.5–1.5 mil.

8. The improved activation device of claim 1, wherein said opening sealed by said membrane is of diameter in the approximate range from 5/16–3/8 inch.

9. The improved activation device of claim 8, wherein said headspace volume is at least 2 ml.

10. The improved activation device of claim 8, wherein said headspace volume is at least 3 ml.

11. The method of claim 1, further comprising, during said step of supplying pressure into the dispensing container, maintaining said trigger enclosure therein in a position wherein the membrane is near the bottom of the trigger enclosure.

12. The method of claim 11, further comprising, during said step of supplying pressure, locating said membrane in a reservoir of said first component of the gas generating system.

13. The improved method of activating a trigger in a pressure generating system used in combination with a dispensing container for flowable product, containing a trigger enclosure and an at least two-component gas generating system, in which the dispensing container holds at least a first component of the gas generating system externally of the trigger enclosure, and the trigger enclosure houses a second component of the gas generating system; comprising:

providing a trigger enclosure that is at least semi-rigid and defines an external opening therethrough and a housing internal volume therein;

placing in said housing internal volume a relatively lesser volume of said second component of the gas generating system, thereby providing a headspace;

selecting a membrane of material capable of rupturing under a preselected externally applied pressure when covering an opening of the size of said opening in the trigger enclosure and with the headspace provided therein;

sealing said opening in the trigger enclosure with said membrane;

locating the trigger enclosure in said dispensing container;

sealing the dispensing container; and supplying pressure into the dispensing container in quantity sufficient to deform the membrane into the housing internal volume and thereby rupture the membrane.

14. The method of claim 13, wherein said step of supplying pressure into the dispensing container comprises:

providing a product dispense valve in communication with said dispensing container;

connecting a source of pressurized fluid to said product dispense valve; and back flowing pressurized fluid into the dispensing container through the valve.

15. The improved method of claim 13, wherein said step of providing a trigger enclosure further comprises providing a material having the semi-rigid characteristics of approximately 0.025 inch thick plastic configured as a tube of approximately 0.5 inch outside diameter.

16. The improved method of claim 15, wherein said step of selecting a membrane further comprises selecting a membrane material having the rupturable characteristics of low density polyethylene having a thickness of from about 0.4–2.0 mil.

17. The improved method of claim 16, wherein said step of placing the second component of the gas generating system in the housing internal volume further comprises placing a sufficiently lesser volume of the second component to provide a headspace volume of at least 2 ml.

18. The improved method of claim 16, wherein said step of supplying pressure into the dispensing container further comprises supplying approximately 10–20 psig.

19. The improved method of claim 13, wherein:

said step of providing a trigger enclosure further comprises providing said trigger enclosure in the shape of a tube, wherein said opening is an open end of said tube; and said step of sealing the opening is by placing a cap over the membrane and over the open end of the tube, wherein said cap defines a hole therein overlying at least a portion of said membrane and the open end of the tube.

20. The improved method of claim 19, wherein said step of sealing the opening further comprises the step of providing a cap that defines a hole of diameter in the approximate range from 5/16–$\frac{3}{8}$ inch.

* * * * *